United States Patent [19]

Keane

[11] 4,096,659

[45] Jun. 27, 1978

[54] SPIN THE SAUCER

[76] Inventor: Eunice R. Keane, 11 Maeven Ave., Kingston 10, Jamaica

[21] Appl. No.: 806,546

[22] Filed: Jun. 14, 1977

Related U.S. Application Data

[63] Continuation of Ser. No. 610,658, Sep. 5, 1975, abandoned, which is a continuation of Ser. No. 530,816, Dec. 9, 1974, abandoned.

[51] Int. Cl.[2] ..... A63H 1/32

[52] U.S. Cl. ..... 46/47; 46/52

[58] Field of Search ..... 46/47, 52

[56] References Cited

FOREIGN PATENT DOCUMENTS 604,841 12/1933 Germany ..... 46/47

OTHER PUBLICATIONS

Playthings Publication, Feb. 10, 1959, p. 105.

*Primary Examiner*—Louis G. Mancene
*Assistant Examiner*—Robert F. Cutting
*Attorney, Agent, or Firm*—Donald A. Kettlestrings

[57] ABSTRACT

This invention relates to spinning -toss and catch- toys which children and adults may operate with a minimum of skill and practice yet it is also a highly skilled competition toy when operated dually by one or two persons or in numbers by a group of persons.

9 Claims, 3 Drawing Figures

SPIN THE SAUCER

This is a continuation of application Ser. No. 610,658, fled Sept. 5, 1975, now abandoned which in turn, was a continuation application of Ser. No. 530,816 filed Dec. 9, 1974 now abandoned.

An object of the invention is to produce an inexpensive safe toy which is for widely differing age groups yet can be operated with a minimum of skill yet can also call for a maximum skill in dual, multiple and competitioe type operation.

Another object of the invention is to produce a spinningtoss and catch toy, which when operated by a rotating wand while spinning must be repeatedly tossed into the air and caught again or be tossed to some other player equipped with a like wand and so to be played with the object of a continuous rotation of the dome-shaped top without said top ceasing its revolving motion or falling to the ground.

Figure 1:
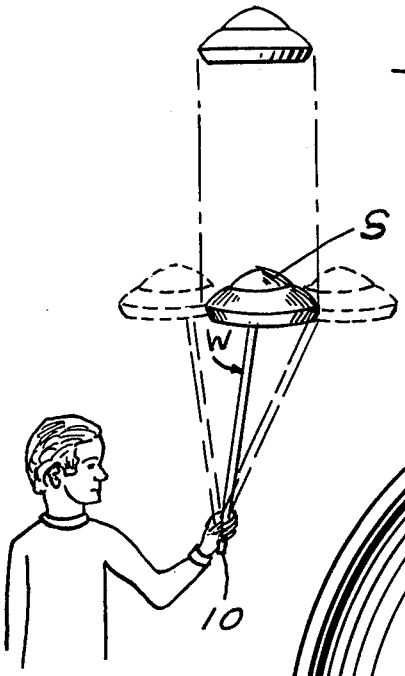
FIG. 1 is a perspective view of the toy in use; and while still spinning having been tossed into the air and caught again on one of its inner rims.
Figure 2:
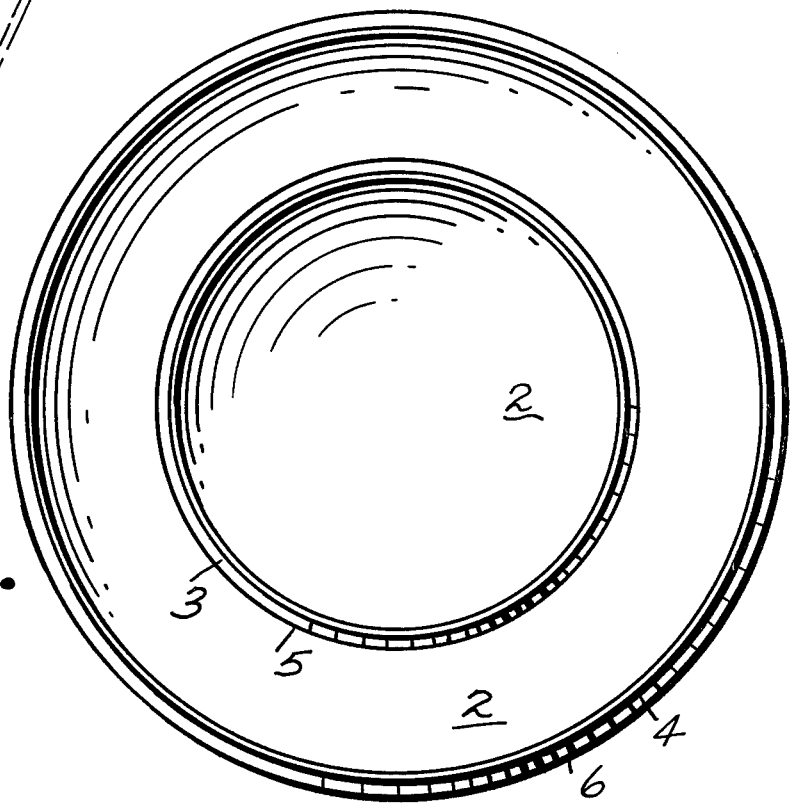
FIG. 2 is a bottom plan view of the toy.
Figure 3:
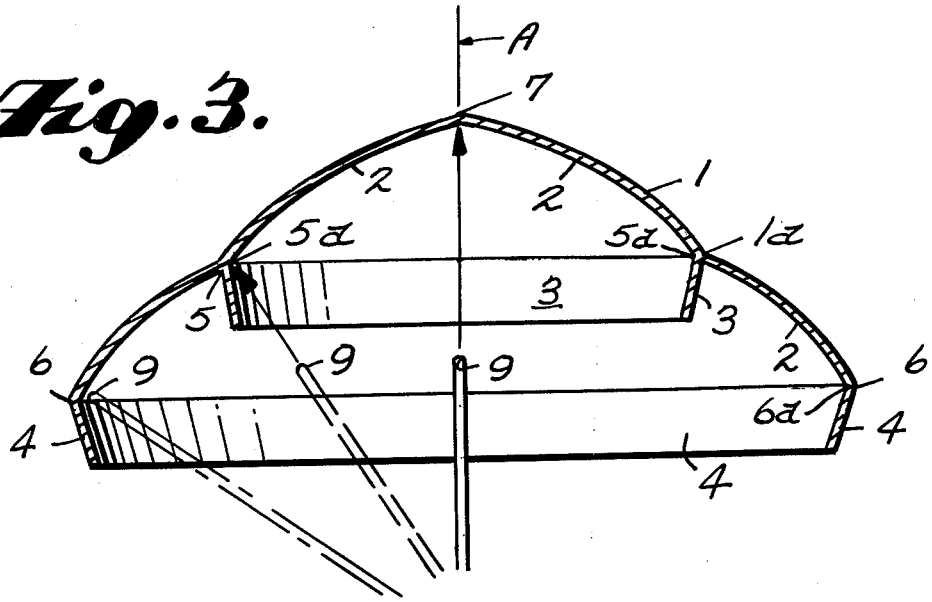
FIG. 3 is a vertical section view of the two-tiered dome-shaped top showing the wand in elevation at the inner domed apex and at generally center and bottom rims.

Referring to the drawings, the embodiment of the invention shown in FIGS. 1–3 comprises two parts, a two-tiered dome-shaped top S and a wand W.

The two-tiered dome-shaped top S may be a one piece construction of any desired material such as moulded plastic, polyethelenes rubber, or cardboard or the like. The two tiered dome-shaped top S is formed with a shell having a top apex 7, an outer surface 1, and an inner surface 2. Apex 7 widens down evenly to show on its smooth outer surface 1 a distinct circular impression or depression 1*a*, Inner surface 2 similarly widens down evenly to a first lip 5 defining a first circular opening 5*a* adjacent to depression 1*a*. Inner surface 2 extends from lip 5 to a second lip 6 defining a second circular opening 6*a*. Inner surface 2 is formed with tiered circular rims 3–4 with center or first rim means or member 3 extending from lip 5 and with bottom or second rim means or member 4 extending from lip 6.

The two-tiered appearance of top S is enhanced by the characteristic of the outer surface 1 of the shell whereby a first portion of the outer surface between the apex 7 and depression 1*a* is generally convex and whereby a second portion of the outer surface between depression 1*a* and second lip 6 is also generally covex. In addition, in order to facilitate placement of wand *w* against rim member 3,4 these rim members are angled slightly inwardly toward common axis A of the top.

The rotary wand W is formed with a generally founded upper end 9 and a non-rounded end 10. The wand W may be constructed of any desired material such as moulded plastic, wood, metal or the like.

To operate the Toy, the wand W is held vertically at the non rounded end 10 and the two tiered dome-shaped top S is held horizontally on the wand W so that the inner dome-shaped apex 7 is against the rounded end 9. When the operator imparts a gentle pull of the two tiered dome-shaped top S towards self it will start to spin. Then the operator rotates the wand W in a generally circular motion and at a certain rate of rotation the rounded end 9 of the wand W moves out to the generally center rim member 3. Continuing motion of wand W keeps top S spinning until a generally vertical manipulation of wand W directs the top S spinning into the air. At some point of its descent the top is caught at generally center rim 3 at circular bottom rim 4, or at inner dome apex 7 by wand W on rounded end 9 whereby continuing rotary motion and vertical manipulation of wand W keeps the top spinning on wand W or in the air permitting continuous play. Accordingly, the top is kept spinning on wand W or in the air and is prevented from falling to the ground.

The foregoing is to be considered as illustrative only of the principles of the invention since many modifications will readily occur to those skilled in the arts.

What is claimed is:

1. A toy for use with a wand, said toy comprising a hollow, generally dome-shaped shell having a wall with an inner and an outer surface; said wall defining an apex and said inner surface having a first lip defining a first opening; said wall extending from said first lip to a second lip defining a second opening; a first rim means extending from said inner surface at said first lip for engaging an end of said wand and for enabling rotating movement of said wand to cause said toy to spin about said wand; and a second rim means extending from said inner surface at said second lip for engaging an end of said wand and for enabling rotating movement of said wand to cause said toy to spin about said wand.

2. A toy as in claim 1 wherein said outer surface defines a depression adjacent to said first lip.

3. A toy as in claim 2 wherein said outer surface of a first portion of said wall between said apex and said depression is substantially convex and wherein said outer surface of a second portion of said wall between said depression and said second lip is also substantially convex.

4. A toy as in claim 3 wherein said depression, said first opening and said second opening are substantially circular about a common imaginary axis.

5. A toy as in claim 4 wherein said first and second rim means extend inwardly toward said axis.

6. A toy as in claim 5 wherein said wall is aperture-free.

7. A toy as in claim 1 wherein said first and second rim means are each of sufficient dimensions to readily enable said wand to remain engaged therewith while said wand is being rotated to cause said toy to spin about said wand.

8. A toy as in claim 1 in combination with a wand having a first rounded end, said wand adapted to be hand held adjacent to a second end thereof, to engage said rounded end with the interior of said apex whereby rotating movement of said wand causes said toy to rotate and to engage said rounded end with said first rim means and with said second rim means as said toy is spun.

9. A toy comprising a hollow, generally dome-shaped shell having a wall with an inner and an outer surface; said wall defining an apex and said inner surface having a first lip defining a first opening; said wall extending from said first lip to a second lip defining a second opening; a first rim member extending from said surface at said first lip; a second rim member extending from said lip; and wherein said outer surface of a first portion of said wall between said apex and said depression is substantially convex and wherein said outer surface of a second portion of said wall between said depression and said second lip is also substantially convex.

* * * * *

UNITED STATES PATENT AND TRADEMARK OFFICE

CERTIFICATE OF CORRECTION

PATENT NO. : 4,096,659

DATED : June 27, 1978

INVENTOR(S) : Eunice R. Keane

It is certified that error appears in the above-identified patent and that said Letters Patent are hereby corrected as shown below:

claim 9, line 6, between "said" and "surface" insert -- inner --.

line 8, between "said" (first occurrence) and "lip" insert -- second --.

Signed and Sealed this

*Twenty-eighth* Day of *November 1978*

[SEAL]

*Attest:*

RUTH C. MASON
*Attesting Officer*

DONALD W. BANNER
*Commissioner of Patents and Trademarks*